United States Patent [19]

Ohta

[11] Patent Number: 4,773,557

[45] Date of Patent: Sep. 27, 1988

[54] PROTECTIVE COVER STRUCTURE FOR A CONTAINER

[76] Inventor: Toshimichi Ohta, 78-460 Shimoshinden-cho, Maebashi, Gumma, Japan

[21] Appl. No.: 152,257

[22] Filed: Feb. 4, 1988

[30] Foreign Application Priority Data

Mar. 27, 1987 [JP] Japan ..... 62-44169[U]

[51] Int. Cl.[4] ..... B65D 51/22

[52] U.S. Cl. ..... 220/258

[58] Field of Search ..... 220/269, 270, 258

[56] References Cited

U.S. PATENT DOCUMENTS 4,039,101 8/1977 Wells ..... 220/269
4,125,203 11/1978 Sovari et al. ..... 220/258
4,673,099 6/1987 Wells ..... 220/258

*Primary Examiner*—George T. Hall
*Attorney, Agent, or Firm*—Bierman & Muserlian

[57] ABSTRACT

A cover structure of a container is disclosed. The container consists of a cylindrical body and end plates of sheet metal. A retained cover disk with a ring like knob is formed in one of the end plates and can be removed from the end plate along a weakened cutting line provided in the end plate for defining the retained cover disk by pulling up the knob. An outer cover is made of a flexible material, provided with a short peripheral side wall and covers the retained cover disk. The surface of the outer cover is provided with an aperture to insert the knob. The outer cover is removed together with the retained cover without exposing a peripheral edge of the cover disk to be cut out from the peripheral wall of the end plate.

6 Claims, 3 Drawing Sheets

PROTECTIVE COVER STRUCTURE FOR A CONTAINER

This invention relates to a cover structure of containers, and more particulary to a removable outer cover structure of the container having a retained metal cover disk.

[BACKGROUND OF THE INVENTION]

It is well known that a container or can with a retained metal cover disk which can be cut away from one of the end walls of the container body along a weakened cutting line provided at a peripheral edge of the disk by raising up and pulling a ring like knob attached to a portion of the retained cover disk. In the container with the retained cover disk for sealing up contents such as, for example tennis balls, therein, the retained metal cover is covered by a removable outer cover made of a flexible material.

In order to remove the retained metal cover disk from the container body, it is necessary to remove the outer flexible cover, raise up the ring like knob from the surface of the retained metal cover disk, and then pull up the knob for cutting off the weakened line on the retained metal cover. There is, however, danger that a hand or finger of the user is often injured with a sharp edge of the metal cover while it is removing from the container body.

[OBJECT OF THE INVENTION]

In view of the foregoing, a principal object of the present invention is to provide an outer cover structure of the container which is capable of removing a retained metal cover disk from the container body in safety.

[DESCRIPTION OF THE PREFERRED EMBODIMENT]

Figure 1:
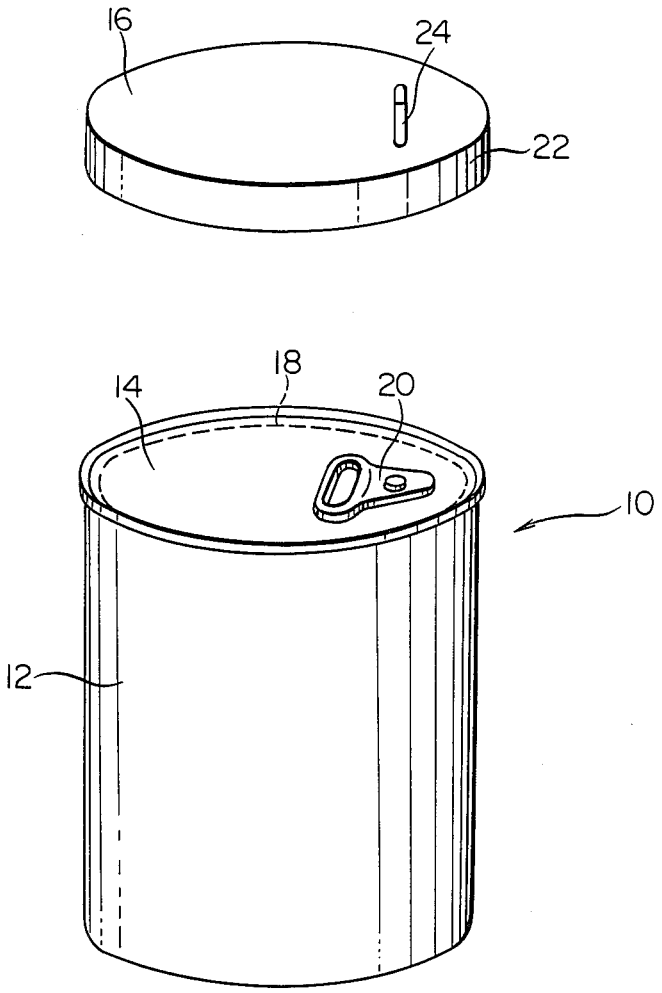
FIG. 1 is a schematic perspective illustration of a container embodying the present invention, and in which the outer cover is shown in spaced apart relation.

Referring now in detail to the drawings, as shown in FIG. 1, a container 10 is formed of a cylindrical hollow body 12 with end walls made of sheet metal in which contents (A) can be sealed. A retained cover disk 14 is formed in one of the end walls of the container body 10 and defined by a weakened cutting or seam line 18 formed in a peripheral edge of the end wall. A ring like knob 20 is fixed to a portion of the retained cover disk 14 for removing away the retained cover disk 14 from the end wall along the weakened line 18 when the ring like knob 20 is manipulated. Further the retained cover disk 14 is covered by a removable outer cover 16 which is made of a soft and flexible material, such as, for example, flexible plastic, and is provided with a short peripheral side wall 22.

Figure 2:
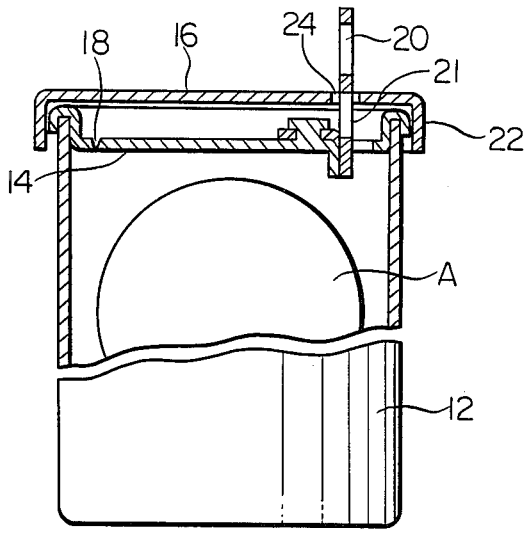
FIG. 2 is a partly sectional illustration of the retained metal cover disk in which a ring like knob is raised up from the surface of the disk and a portion of the knob is inserted into a slit or aperture in the outer cover.
Figure 3:
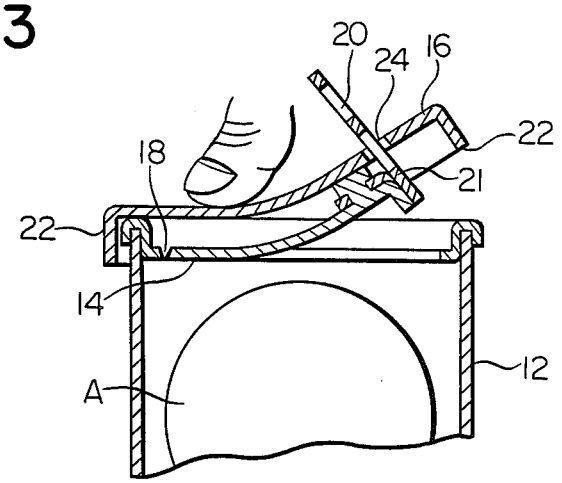
FIG. 3 is a partly sectional view showing that the retained metal cover disk is removed together with the outer cover.

As shown in FIGS. 1 to 3, the outer cover 16 is provided with a slit or aperture 24 for inserting and manipulating the ring like knob 20 into it after it has been raised up from the surface of the retained cover disk 14. As is understood from FIG. 2, the outer cover 16 can be removed from the container body 12, the knob 20 is raised up to make right angles to the surface of the retained cover disk 14. The portion of the ring like knob 20 can be inserted into the slit or aperture 24 in the outer cover 16, and then it can be mounted on the container body 12 so as to cover the retained disk 14.

Figure 4:
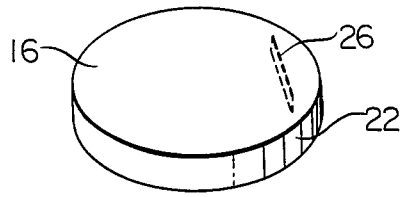
FIG. 4 through FIG. 11 are respectively a schematic illustration explaining several modifications according to the present invention.
Figure 5:
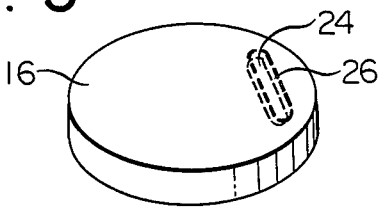

It is unnecessary that the aperture or slit 24 is of the full open, and, as shown in FIGS. 4 and 5, it is possible to form from a weakened cutting or seam line 26 so that the aperture 24 is formed when the portion of the ring like knob 20 is inserted into the area defined by the weakened cutting line 26.

Figure 6:
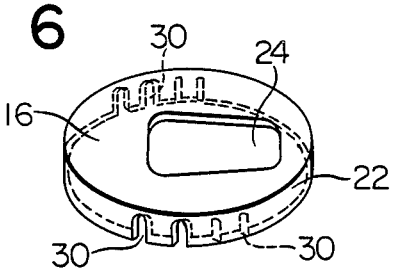

Further, as illustrated in FIG. 6, the aperture 24 may be made in the form of, for example, the tongue whereby the knob 20 can be accessed and raised up without removing the upper cover 16.

Figure 7:
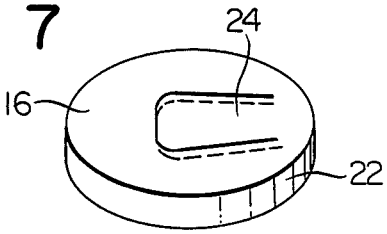
Figure 8:
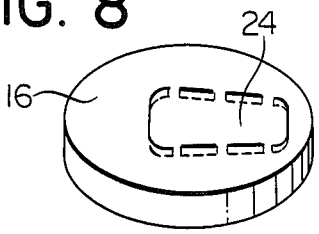

As shown in FIGS. 7 and 8, a portion of the outer cover 16 may be provided with a seam line for forming the contour of the aperture 24. form of the tongue and to form the aperture 24 in that place, as shown in FIGS. 7 and 8.

Figure 9:
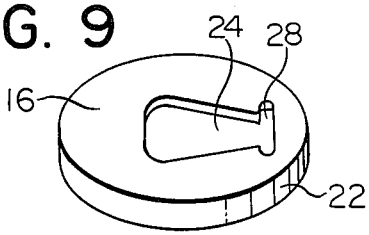

If necessary, as shown in FIG. 9, the aperture 24 is provided with a narrow groove 28 whereby the base portion of the ring like knob 20 is inserted into the groove 28 when the knob 20 is raised up from the surface of the disk 14.

Figure 10:
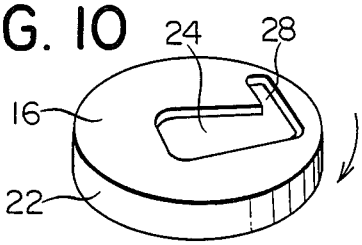
Figure 11:
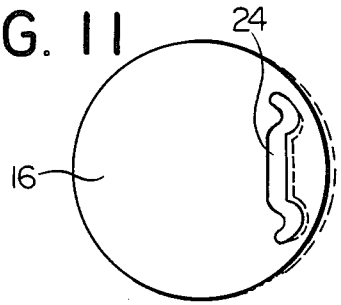

Further, as shown in it FIG. 10, a narrow groove 20 can be elongated from one end of the base of the aperture 24 so that the base portion of the ring like knob 20 may be inserted into it when the knob 20 is raised up from the surface of the disk 14 and the outer cover 16 is slightly turned as shown in an arrow. In other embodiment, as shown in FIG. 11, the aperture 24 in the outer cover 16 may be formed in W-type so as to deform the aperture 24 slightly by the ring like knob 20 inserted into the aperture 24.

The aperture 24 and narrow groove 28 in the outer cover 16 can be changed in the form within the scope of the invention.

As the present invention is constructed as set forth in the foregoing, the the contents (A) sealed within the container can be available by removing the outer cover 16 from the container body 12, rising the ring like knob 20 by inserting or without inserting the knob 20 into the aperture 24 in the retained cover disk 16, and pulling out the retained cover disk 14 by the ring like knob 20. The surface of the flexible outer cover 16 is bent or curved to accord with the deformation of the retained cover disk 14 while it is removing from the container body 12 by manipulating the ring like knob 20, and the peripheral edge of the retained cover disk 14 is cut away along the weakened cutting line 18. The peripheral edge of the disk 14, however, is covered by the peripheral side wall 22 of the outer cover 16. Accordingly, fingers or hands will not be harmed by the peripheral edge of the cover disk 14.

In addition, it is possible to provide a notch or notches 30 in a desired position of the peripheral side wall 22 of the flexible outer cover 16 so that it may easily be removed from the container body 10 together with the retained cover disk 14.

While the invention has been particulrly shown and described with reference to preferred embodiments thereof, it will be understood by those skilled in the art that the foregoing and other changes in form and details can be made therein without departing from the spirit and scope of the invention.

What is claimed is:

1. A cover structure of a container comprising a cylindrical body, a retained cover disk of sheet metal formed in one of end walls of said container and defined by a weakened cutting line, a ring like knob fixed to said retained cover disk for cutting off said retained cover disk from said weakened line, and a flexible outer cover having a short peripheral side wall, characterized in that said outer cover is provided with an aperture in which said knob is inserted, said flexible outer cover being removed from said container together with said retained cover disk without exposing a peripheral edge of said retained cover disk when said ring like knob is pulled up for tearing said retained cover disk from said end wall.

2. A cover structure of a container as claimed in claim 1 in which said aperture is in the form of a narrow groove, said ring like knob being raised up from the surface of said disk and inserted into said aperture after said outer cover has been removed.

3. A cover structure of a container as claimed in claim 1 in which said aperture in said outer cover is defined by a weakened line whereby said aperture being cut off by means of said knob.

4. A cover structure of a container as claimed in claim 1 in which said aperture is deformed by insertion of said knob.

5. A cover structure of a container as claimed in claim 1 in which said outer cover is curved together with said retained cover disk when said knob inserted into said aperture in said outer cover is pulled up for removing said disk from said end wall.

6. A cover structure a container as claimed in claim 1 in which said knob is directly manipulated through said aperture in said outer cover.

* * * * *